US005454352A

United States Patent [19]

Ward

[11] Patent Number: 5,454,352

[45] Date of Patent: Oct. 3, 1995

[54] VARIABLE CYCLE THREE-STROKE ENGINE

[76] Inventor: Michael A. V. Ward, c/o CEI, 32 Prentiss Rd., Arlington, Mass. 02174

[21] Appl. No.: 161,902

[22] Filed: Dec. 3, 1993

[51] Int. Cl.[6] ..... F02B 75/32

[52] U.S. Cl. ..... 123/53.3; 123/197.1; 123/21

[58] Field of Search ..... 123/55.3, 197.1, 123/311, 21

[56] References Cited

U.S. PATENT DOCUMENTS

| | | | |
|---|---|---|---|
| 1,312,585 | 8/1919 | Shepherd | 123/197.1 |
| 4,301,776 | 11/1981 | Fleming | 123/197.1 |
| 4,387,672 | 6/1983 | Crocker | 123/55.3 |
| 4,493,296 | 1/1985 | Williams | 123/55.3 |
| 4,848,282 | 7/1989 | Chaneac | 123/55.3 |
| 4,974,555 | 12/1990 | Hoogenboom | 123/55.3 |
| 5,218,933 | 6/1993 | Ehrlich | 123/55.3 |

*Primary Examiner*—David A. Okonsky
*Attorney, Agent, or Firm*—Jerry Cohen

[57] ABSTRACT

A virtual three-stroke engine (1) with intake and compression strokes approximately one half of the power stroke of approximately 12 to one expansion ratio and with total firing cycle stroke lengths equal to approximately three expansion strokes to minimize engine throttling and frictional losses over the real world drive cycle and provide high torque from a one-to-one drive shaft RPM to engine firing cycle RPM provided by a cam type driver for controlling the piston motions and extracting the power from the piston.

30 Claims, 6 Drawing Sheets

CYLINDER HEAD
$V_c$
CLEARENCE
END COMPRESSION
END EXHAUST
ENGINE DISPLACEMENT
END INTAKE
INTAKE DISPLACEMENT
END EXPANSION
PR= 12:1
ID= 4/12
CR= 4:1
ER=12:1
Re = 1/12
R/I = .25
η=52%

EXHAUST RESIDUAL (Re)
PR=12:1
ID=5.5/12
CR= 7:1
ER= 8:1
Re=1.5/12
R/I=.27
η=54%

PR=12:1
ID=7/12
CR=9:1
ER=5:1
Re=2/12
R/I=.29
η=56%

0
2
4
6
8
10
12
0°
90°
180°
270°
360°
450°

VARIABLE CYCLE THREE-STROKE ENGINE

BACKGROUND OF THE INVENTION AND PRIOR ART

There is a need today for improving the emissions characteristics and efficiency of the internal combustion (IC) engine. The conventional four-stroke gasoline engine suffers from high air-intake throttling pumping losses at part-load, the typical automotive driving condition, while the two-stroke engine suffers from the opposite problem of requiring an air pump or blower to pressurize air for forcing into the cylinder during the very short duration of air-intake when pressures are above atmospheric. Both engines have a low expansion ratio, the four-stroke gasoline engine limited to approximately 9:1 because of the engine knock limitations of its compression stroke (which equals the expansion stroke), and the two-stroke limited to approximately 7:1 because of the need to open the exhaust valve early to expel the exhaust gases in time to take in the intake air charge in a very short time.

The diesel engine attempts to solve the pumping loss problem of the four-stroke gasoline engine by taking in a full intake charge (maximum amount of air) and controlling engine power by injecting varying amounts of fuel directly into the cylinder (to consume varying amounts of the intake air versus the entire amount of limited (throttled) air in the case of the gasoline engine). While the diesel has low part-throttle air-pumping losses it has high frictional losses due to its high compression ratio (of typically 16:1 to 24:1) and high in-cylinder heat transfer losses due to the high cylinder surface-to-volume ratio. Its constant pressure versus constant volume combustion reduces its Otto cycle efficiency. Also, having to take in a full charge of air at part load and moving it at high friction for the entire compression stroke of the high compression ratio is wasteful from the perspective of the present invention.

Most attempts to alleviate the pumping loss problem of the four-stroke gas engine have had limited success because of the limitations of the processes used. Lean burn reduces pumping loss but by relatively small amounts because of the inability to burn mixtures beyond approximately 25:1 air—fuel ratio (AFR), representing 67% additional intake-air above stoichiometry which is only 50% of total intake air at part-load where only 30% air may be required for stoichiometric combustion. This represents a pumping or throttling loss of 50% i.e. taking the intake air through a pressure drop of approximately 50% of atmospheric.

Other methods of reducing pumping loss rely on variable valve timing, as in the Miller cycle, and again these are only partially successful because they still employ a full intake and compression stroke with the accompanying mechanical frictional losses. There are also losses associated with the intake air motion in and out of the cylinder or of sequentially expanding and compressing the intake air during the valve controlled intake stoke.

General discussions on engine cycles and fuel economy are discussed in many texts, and the following are a sampling of texts which discuss these issues in some degree: "Internal Combustion Engines and Air Pollution" by E. F. Obert (Intext Educational Publishers 1973), "The Internal-Combustion Engine" by Taylor and Taylor, (International Textbook Co., 1970), and "Internal Combustion Engine Fundamentals" by John B. Heywood (McGraw-Hill Book Company, 1988).

On the other hand the present invention employs a different and shorter intake stroke, e.g. 6:1, from the expansion stroke, e.g. 12:1, to be able to, for the average driving condition, have a closer balance between the required intake air and what the piston would draw in during the intake stroke with no or limited air-throttling and with minimum mechanical friction due to the shortened intake and compression stroke. For greater air-intake either a variable intake stroke is employed providing a longer intake stroke when required, or/and an air-intake pressure boosting means is employed, e.g. a quick response compact turbocharger. The different and greater expansion stroke would assure maximum conversion of combustion heat energy to work, i.e. maximum cycle efficiency.

The present invention can be utilized with a variety of fuels including conventional petroleum-derived hydrocarbon mixture fuels, e.g., gasoline, or non-conventional petroleum and/or plant derived fuels, e.g., methanol, ethanol, natural gas, alcohol-hydrocarbon mixtures, etc. Discussion is limited to the conventional go fuels, it being understood that the points discussed herein apply to all fuels with the appropriate correction factors known to those skilled in the art.

Some terms used herein are now defined:

(1) Air-Fuel Ratio (AFR): The weight ratio of air to fuel as the vapor form equivalent of given weights of air and fuel at standard temperature and pressure (STP) in accordance with standard industry practice which takes AFR of 14.7 to one (14.7:1) as a the stoichiometric ratio for gasoline (14.7 lbs of air combusting 1 lb of gasoline).

(2) Gas-fuel ratio (GFR): It is the same as air-fuel ratio except that the component that comprises air in this case includes exhaust gas, i.e. the "gas" comprises a combination of fresh intake air and exhaust gas, where the exhaust gas may comprise "exhaust residual" remaining in the cylinder at the end of the exhaust stroke or exhaust gas recirculation (EGR) into the intake system.

(3) Lean-Burn (or Lean of Stoichiometric, or dilute charge): Operation of an engine at AFR above stoichiometric, i.e. above 15:1 AFR for gasoline engines.

(4) Stratified Charge: Generally is the purposeful formation of a non-uniform fuel-air mixture or charge in the engine cylinder prior to combustion, where a locally richer mixture is produced at the spark plug site to help ignition of an overall leaner mixture.

(5) Manifold Absolute Pressure (MAP): The absolute pressure in units of atmospheres inside the intake manifold of an IC engine beyond the throttle plate, representing the pressure of the air which is inducted into the engine cylinders. A MAP value of 1.0 represents a pressure of one atmosphere at standard temperature inside the engine intake manifold.

(6) Stroke: The displacement of the piston commencing from its one extreme position to another extreme position, which for a standard gasoline or diesel four stroke-engine comprises the sequence of equal lengths of an intake stroke, compression stroke, expansion or power stroke, and exhaust stroke.

(7) Compression Ratio (CR): The ratio of the engine cylinder displacement or volume at the beginning of the compression stroke to the displacement or volume at the end of the compression stroke. Likewise, one can define an "intake ratio" IR, and "expansion (power) ratio" EPR or PR, and an "exhaust ratio" ER.

(8) Cycle: The entire sequence of engine strokes in an IC engine which defines one complete operation of an engine cylinder, as in the four-stroke cycle, the two-stroke cycle, and the more loosely "three-stroke" cycle as defined herein to describe a way to view the current "variable cycle" engine as it is referred to.

(9) Shaft Timing: The angular position in drive shaft degrees, where one drive shaft revolution equals 360 degrees, from some reference point which herein is defined as the end of the compression stroke (also defined as top center, TC, or to remove ambiguity "shaft top center" , or "shaft TC").

(10) Stroke Timing: A specification in "stroke" degrees for a given stroke, e.g. intake, wherein the entire stroke motion is defined equal to 180 stroke degrees in a linear way, i.e. half a stroke is 90 stroke degrees independent of the actual drive shaft rotation. One drive shaft revolution of 360 degrees equals 720 stroke degrees in the preferred cam driver controlled embodiment of the invention. Top center (TC) and bottom center (BC) are defined for each stroke to correspond to the point where the piston is at the top and bottom respectively of its stroke.

(11) Ignition Timing: The degrees before top center (BTC), either in shaft or stroke degrees, where ignition commences.

(12) Valve Timing: The stroke degrees, before and after top center (BTC and ATC) where the intake valve opens and the exhaust valve closes (around the beginning of the intake stroke), the stroke degrees before bottom center (BBC) where the exhaust valve opens (before the end of the power stroke), and the stroke degrees after bottom center (ABC) where the intake valve closes (after the beginning of the intake stroke).

13) Wide Open Throttle (WOT): The operating condition of an engine in which the throttle or other means controlling air-flow into the cylinder is opened to permit essentially the maximum amount of air to enter the cylinder.

14) Throttling Loss: The engine power loss at other than WOT as a result of restricting the intake air flow causing a pressure drop across the throttle. Except where otherwise specified, the term "pumping loss" will also refer to throttling loss in the present disclosure (although it usually refers to high speed, WOT, engine air pumping loss).

Other related terms are defined below as used.

SUMMARY OF THE INVENTION

In discussions of high efficiency or ideal engine cycle efficiency emphasis is placed on the engine cycle efficiency (Obert, "The Ideal Engine", page 179) with less regard to the average vehicle efficiency over the real world drive cycle. Thus, high engine compression ratios are desirable (providing the highest cycle efficiency for a given expansion ratio) and diesel engines and two-stroke engines are preferred for efficiency over four-stroke engines.

On the other hand, the present invention looks at the engine as part of a vehicle system operating over the real world drive cycle and emphasizes the drive cycle efficiency over the engine cycle efficiency which is nevertheless high as a result of the features of the invention. More specifically, the present invention discloses an engine which is designed to provide, with little additional margin, the required power for intaking and compressing the required air (and fuel) for combustion and power to thus minimize mechanical frictional and air-pumping losses to thus also result in a compact, light-weight, and highly efficient engine. The emphasis of the engine is accordingly on the intake and expansion strokes, and secondarily on the compression and exhaust strokes.

In essence, the present invention comprises an IC engine with intake stroke or intake displacement which ideally is variable and which more practically is either fixed or of small variation and which is smaller than the expansion (or power) stroke or displacement. The smaller intake stroke reduces the intake of air at part-load and hence reduces the part-load pumping loss. The smaller intake stroke and generally accompanying smaller compression stroke or compression ratio (CR) minimizes the mechanical friction associated with intaking and compressing the intake air or charge (as it is also referred to). More practically, an IC engine of the Otto Cycle type is proposed with a variable cycle comprised of an intake stroke approximately one half of the expansion stroke (or intake displacement one half the engine displacement) and with a compression ratio (CR) approximately equal to or greater than the intake ratio (IR). Preferably, IR and CR are approximately 6:1 and the expansion ratio EPR and exhaust ratio (ER) are approximately 12:1. For high exhaust residual (for ultra low NOx emissions) the engine has an ER less than EPR (which is approximately 12:1) to provide the higher exhaust residual. The intake ratio IR will be lower, e.g. about 4:1 although intake displacement is preferably unchanged at one half engine displacement and the compression ratio CR will be higher, e.g. about 8:1. The term "about" as used herein means within plus or minus 50% of the value it references, and the term "approximately" means within plus or minus 20% of the value it references.

For higher power where a greater intake of air is required and variable intake is not practical, air boosting means, particularly rapid response turbocharger means are used to supplement the air. The added air intake should be sufficient to just make up the short-fall of the lower, e.g. ½, intake displacement, e.g. inlet pressure should be twice atmospheric, or it can be greater to more than make up for greater power and lower emissions through use of exhaust dilution at WOT.

Generally, the sum of IR and CR is approximately equal to EPR, so that in terms of total cycle displacement the engine equals approximately three expansion ratios, hence the reference to "three-stroke". Also, although the engine has actually four strokes, in its preferred embodiment it has the same feature as the two-stroke of one drive-shaft revolution per engine firing cycle, versus two drive-shaft revolutions for the conventional four-stroke gasoline engine.

The "three-stroke" engine preferably achieves the variable cycle ratio by using cam means (instead of conventional crank-shaft means). The cam is shaped generally elliptically but asymmetric and mounted on a drive shaft to make contact with the moving element (the connecting rod) by means of a track along or near its edge to which is connected a double-ended captured cam follower which in turn is mounted on the end of a connecting rods rigidly mounted to pistons. Unlike the "Herrmann cam engine" developed by Dyna-Cam Industries, Redondo Beach, California, the cam means proposed herein has the end of the (piston) connecting rod riding on the edge of the cam instead of on its face so that the drive shaft is perpendicular to the piston motion as in a conventional piston engine. This makes it usable in conventional engines and makes it particularly useful in a horizontally opposed engine (or radial engine) where it provides substantial advantages of very low height and sufficiently small width for easy access to the top of the cylinders. The drive shaft can also drive the valves to eliminate the need for a separate cam shaft that is normally required.

Since the drive shaft turns once per engine cycle versus twice (eliminating the need for a separate cam) it also provides higher torque per shaft RPM and smoother operation which would permit slower idle speed for better fuel economy.

Preferably two plugs per cylinder of state-of-the-art high power ignition of 100 watts or greater spark power is used to provide improved combustion of dilute mixtures, such as lean and high exhaust residual mixtures, for reduced emissions, reduced heat transfer losses, and further reduction in pumping losses for even higher efficiency. That is, for an intake stroke designed for 60% power (based on engine displacement), e.g. IR is 6:1 and ER is 12:1, operation at 25:1 AFR at light load of 30% of full load reduces pumping loss from 50% (30%/60%) to 16% (50%/60%). The remainder 40% needed power is supplied by air-boosting means which preferably provide in excess of the 40% requirement so that exhaust dilution can be used at WOT for minimum NOx. For designs of high exhaust residual intake air swirl is preferred to provide some stratification of the mixture to help improve idle stability.

Other advantages of the design are easy cranking and easy cold start when engine friction is high. This will result in lower cold start HC emissions because of the low engine friction (essentially three instead of four strokes) and low compression forces to allow for cold-start idle with less fuel.

It is therefore a principal object of the present invention to provide a new engine system which is ideal from the average drive cycle perspective in that it provides minimum mechanical friction and air pumping losses through minimizing the piston motion required for air intake to supply the required air with minimum throttling but with a high expansion ratio for high thermodynamic cycle efficiency. It is another object to implement this engine cycle in an engine design which is compact (of small height to accommodate low aerodynamic car hoods) and which can be enhanced for ultra-low emissions through dilute combustion operation.

The system is explained in further detail and other objects, features, and advantages of the invention will be apparent from the following detailed description of preferred embodiments given, by way of example, in conjunction with the accompanying drawings.

DESCRIPTION OF PREFERRED EMBODIMENTS

FIG.1 *a* is a Pressure-Volume diagram of an "ideal" Otto cycle engine as referred by Obert, page 179. The line a/b represents compression, b/c is heat addition or combustion, c/d is expansion or power, d/e is blowdown, e/f is exhaust, and g/a is intake. In this "ideal" cycle the compression ratio equals the expansion ratio, and the intake ratio equals the exhaust ratio, which equal the compression and expansion ratio. No pumping loss is depicted (curve defined by the points e/f/g/a is a line with no area) which is not realizable but can be approximated at WOT and at moderate engine speeds in a real engine. The efficiency EFF of this cycle is given by:

$$EFF=1-1/[(CR)^{**}(k-1)]$$

where CR is the compression/expansion ratio equal to Va/Vb, k is the ratio of specific heats of the working air-fuel mixture fluid, and "**" denotes exponentiation. For the typical automotive case of a compression ratio CR of 8.5:1 and k of 1.35 the cycle efficiency is 53%.

Figure 1A:
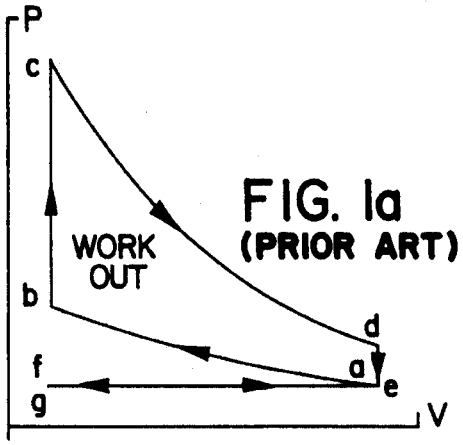
FIG. 1a (PRIOR ART)
FIGS. 1*a* through 1*d* are prior art Pressure-Volume representative engine cycles for four stroke engines.
Figure 1C:
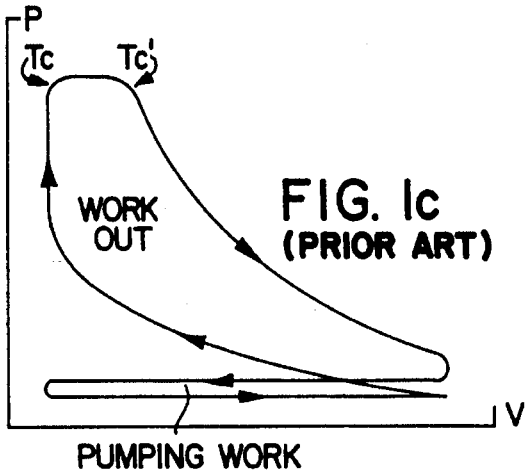
FIG. 1c (PRIOR ART)
Figure 1B:
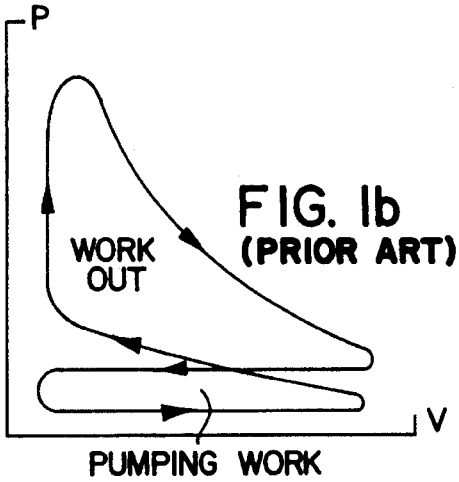
FIG. 1b (PRIOR ART)

A more realistic engine cycle based on the "ideal" engine model of FIG. 1*a* is shown in FIG. 1*b*, representing a gasoline (or "gas" engine as it may also be referred to) at part load with a more realistic pumping work loss indicated by the small area defined by the exhaust and intake strokes. FIG. 1*c* is an engine cycle diagram of a diesel engine indicating less pumping work but higher compression and expansion ratios. Its ideal cycle efficiency for the same compression and expansion ratio is less than the ideal gas cycle of FIG. 1 a since combustion (heat addition) occurs at constant pressure rather than constant volume, and is given by:

$$EFF=1-1/[(CR)^{**}(k-1)]^{*}[f(k,Tc'/Tc)]$$

where the function f is greater than one and depends on k and on the ratio of the temperature at the end of the constant heat addition (Tc') and the beginning (Tc).

Note that diesel engine cycle efficiency typically peaks at 12:1 compression ratio and then degrades, so that the practical cycle efficiency for the very high compression ratio diesel can be taken as 12:1 for purposes of comparison. For the typical case of moderate load where the function "f" may be approximately 1.15 the diesel engine cycle efficiency is 52% for the 12:1 compression ratio, essentially equal to that of the gas engine.

Figure 1D:
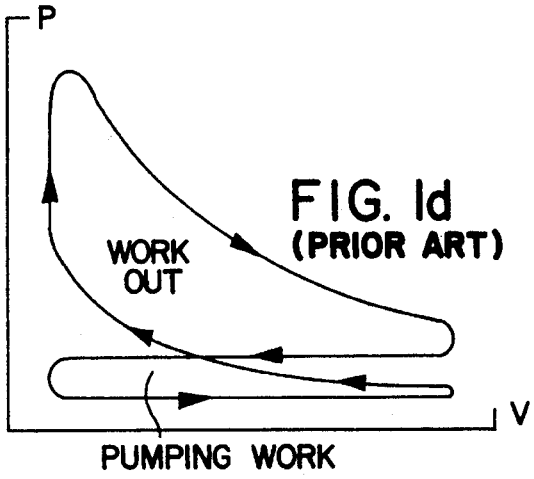
FIG. 1d (PRIOR ART)

FIG. 1*d* depicts a form of Miller cycle where the pumping work is reduced by holding the intake valve open late into the intake stroke. It is an example of a system which makes use of variable valve timing to advantage as is currently being studied by those versed in the art of variable valve timing.

Figure 2A:
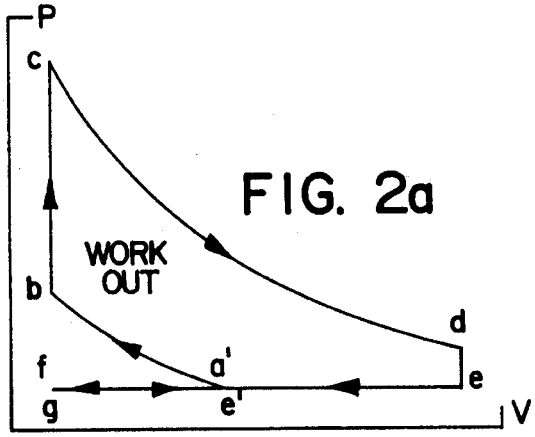
FIGS. 2*a* and 2*b* are idealized and real part-load Pressure-Volume engine cycles of the present variable cycle engine.

FIG. 2*a* depicts the Ideal Variable Cycle Engine of the present invention which is similar to that of FIG. 1*a* except that the intake stroke g/e' is shortened, as is the compression stroke a'/b. For high expansion ratios with minimum blowdown pressure the cycle efficiency is given approximately by:

$$EFF=1-\{k/[ER^{**}(k-1)]\}^{*}\{k^{*}(R-1)/[(R^{**}k)-1)]\}$$

where ER is the expansion ratio, R is Ve/Ve', and "*" denotes multiplication.

For the typical preferred case of an expansion ratio ER of approximately 12:1 and an intake and compression ratio approximately 6:1 the cycle efficiency is 52%, essentially equal to the conventional gas and diesel engine cycles. For the case of a lower exhaust ratio than expansion ratio (for higher residual) and hence a higher compression ratio of say 8:1, and for the intake displacement still equal to approximately half the engine displacement, i.e. Ve/Ve' approximately equal to 3/2, the cycle efficiency is a higher 55%.

Figure 2B:
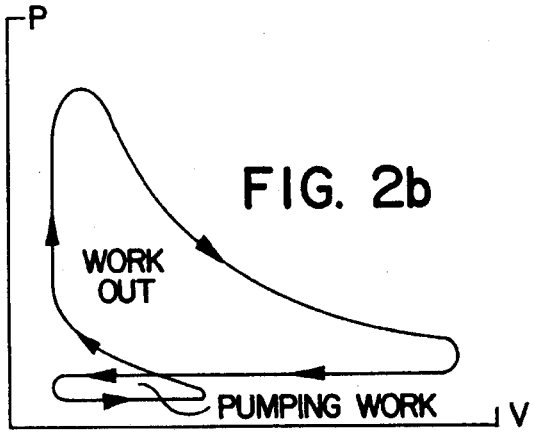

Since the "three-stroke" cycle, shown more realistically in FIG. 2*b*, has substantially lower frictional and pumping losses than the conventional gas engine and substantially lower frictional and heat transfer losses than the diesel engine (but comparable pumping losses), it will have a higher overall efficiency because its cycle efficiency is comparable to the gas and diesel engine cycles as disclosed.

The cycle of FIGS. 2*a* and 2*b* assume a fixed intake ratio IR (Vg/Ve') and compression ratio CR (Va'/Vb) of preferably approximately half the expansion ratio ER (Vc/Vd). This would reduce the pumping loss by half at idle speeds where the manifold pressure might be 0.5 versus 0.25 atmospheres, and with the preferred lean burn operation would further reduce the pumping loss. Ideally, the intake stroke is variable so that it is further shortened at idle. e.g. IR would be, say, 4:1 at idle, and 6:1 nominally, and 8:1 at maximum load where preferably a small quick response turbo would engage to supplement the intake air to a level equal to what would be inducted by the total engine displacement.

However, even for a low intake ratio of, say, 6:1 (for low pumping and frictional loss), the combination of: 1) good lean burn engine capability brought about through high power ignition and other means including greater induced air turbulence, and 2) use of a quick response turbo, the three-stroke engine can be operated with adequate power and response.

Figure 3:
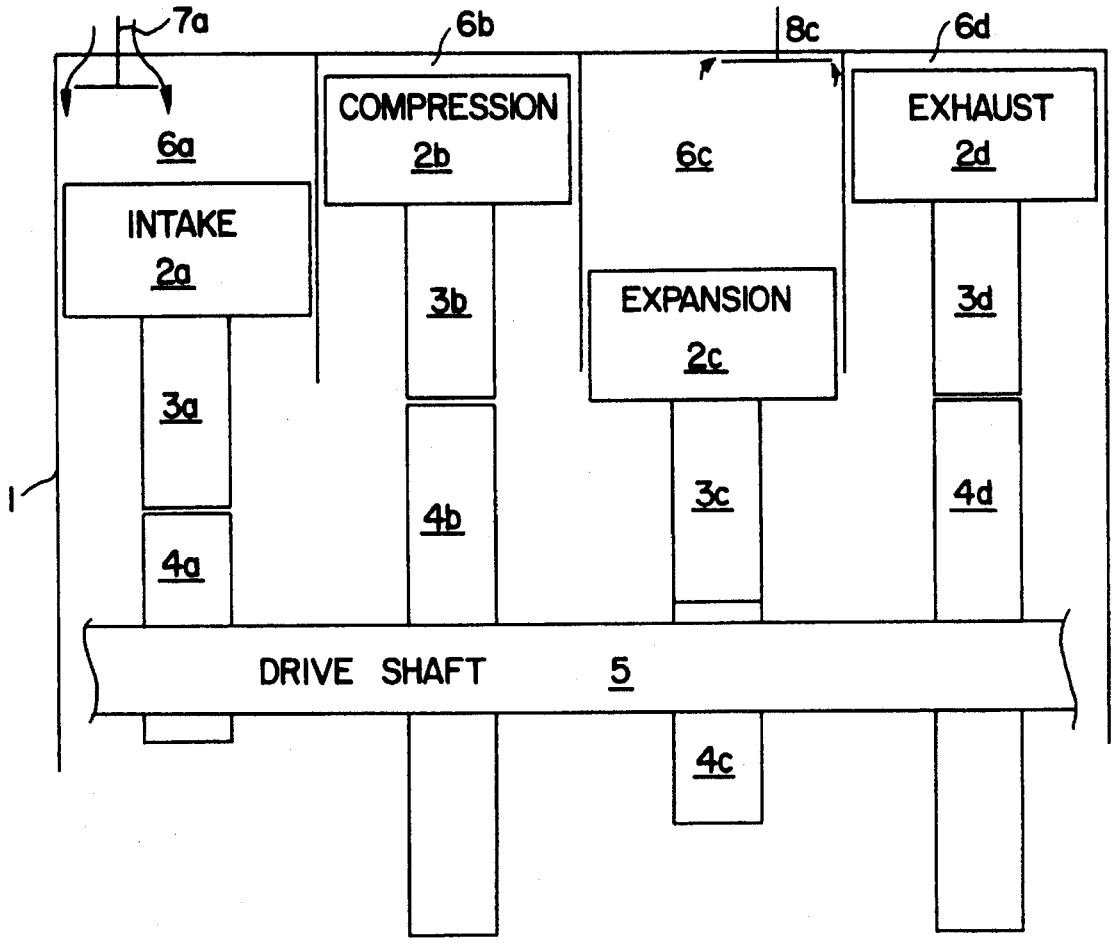
FIG. 3 is an approximately ⅜ scale partial schematic side-view drawing of an in-line four cylinder engine employing the preferred cam type rotating driver for providing a required piston motion for the three-stroke engine.

FIG. 3 is an approximately ⅜ scale partial schematic drawing, i.e. lacking details, of a side-view of an in-line four cylinder engine 1 with pistons 2*a* through 2*d* rigidly connected to the connecting rods 3*a* through 3*d* respectively which ride on the cam end surfaces of cams 4*a* through 4*d* respectively which are mounted on the drive shaft 5. The pistons 2*a* through 2*d* define engine cylinder volumes 6*a* through 6*d* respectively. Volume 6*a* represents the maximum intake volume Vi of stroke length Li defined by the piston at bottom center intake, BCI (where the intake valve 7*a* is closing), and volume 6*c* represents the maximum expansion power volume Vp of stroke length Lp with the exhaust valve 8*c* just beginning to open. For this approximately ⅜-scale engine partial schematic drawing is shown a bore of approximately 3.5", an intake stroke of length Li approximately 1.5" (cylinder length of 2"), a minimum compression and exhaust clearance volume Vcl of length Lcl of approximately ⅜", and an expansion stroke Lp of approximately 3" representing a typical four cylinder engine. A major drawback of this engine design is the great height requirement of greater than five times expansion stroke (excluding the space required for the valve train).

Figure 4:
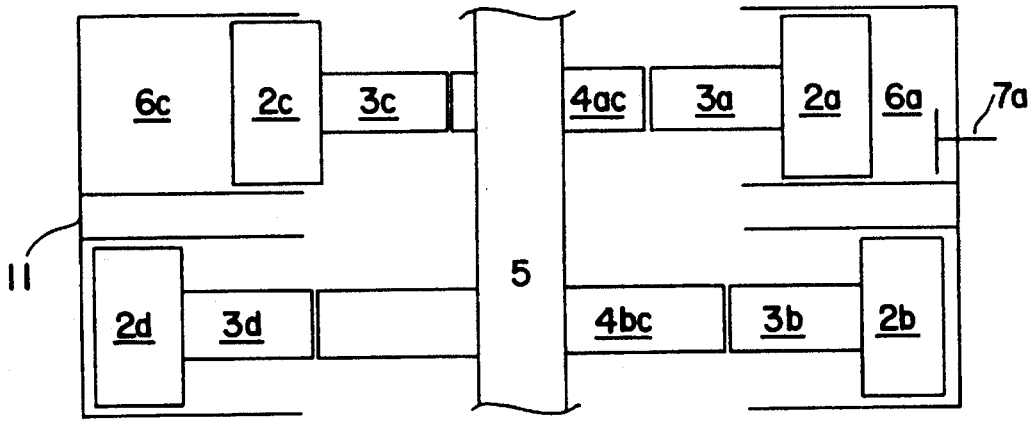
FIG. 4 is an approximately ¼ scale partial schematic drawing of a top view of a four cylinder opposed-piston type engine which more optimally makes use of both the three-stroke aspect and the preferred cam type rotating driver.

The engine height disadvantage associated with the cam driver structure (disclosed with reference to FIG. 5) is alleviated (actually turned to advantage) in the preferred opposed piston design of FIG. 4, which is a special case engine 11 of a preferred radial engine with an arbitrary number of radially disposed cylinders about one cam device. This drawing is an approximately ¼-scale schematic top view of the engine and lacks details. Like numerals refer to like parts with respect to FIG. 3. The two cam devices 4*ac* and 4*bc* are preferably phased 90 drive shaft degrees apart to provide one power stroke per 90 degrees of shaft revolution. Based on the ¼-scale, this engine would have a bore of approximately 4" and a stroke of 3", and strokes similar to the engine of FIG. 4. This preferred design is further described with reference to FIG. 7.

Figure 5:
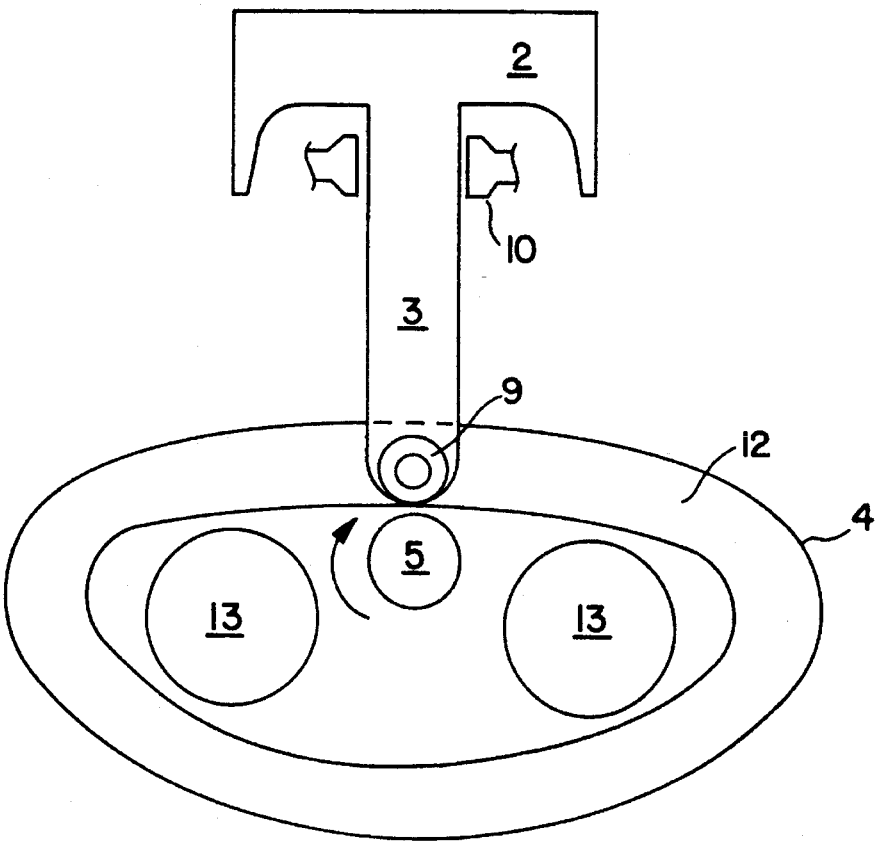
FIG. 5 is an approximately ½ end view drawing of one piston and a cam driver depicting the piston connecting rod end defining a cam follower connected to the cam end or edge for producing the required motion.

FIG. 5 depicts the preferred cam drive mechanism 4 (4*ac*, 4*bc* of FIG. 4) in an approximately ½-scale end view, connected to a piston 2 through the connecting rod 3 rigidly attached to the piston. The piston is shown in a position representing the end of the expansion stroke (at its most bottom position) with its cam follower means 9 adjacent to the drive shaft 5. Also shown is a bearing 10 to guide the connecting rod and to handle side-ways forces. The cam follower rides in a track 12 shown schematically and in detail in FIGS. 6*a* and 6*b*. Circles 13 are cut-outs for reducing the weight of the cam and for balancing.

In operation, as the cam 4 rotates from the position shown in the clockwise direction indicated. There is a component of force in the axial direction of the connecting rod 3 from the bottom of the cam follower to move the piston up towards the top position of the exhaust stroke. Once past the top of the exhaust stroke there is a downwards force component at the top of the cam follower pulling the piston down. The cam driver 4 continues to rotate through the intake and compression strokes as a result of its inertia (as in conventional engines) and once past the top of the compression stroke undergoes a torque about the shaft 5 produced by the piston 2 and connecting rod 3 pushing downwards in the power stroke to transfer the piston linear force to the cam rotational force or torque. The moment arm of the torque is defined by the line normal to the cam surface at the cam follower 9 contact point and a line from the shaft 5 intersecting that line at 90 degrees (whose length is the moment arm). The generally elongated essentially partially elliptical shape of the cam driver 4 insures that the, axial force of the piston and connecting rod is effectively translated to torque in the cam driver.

Figure 6A:
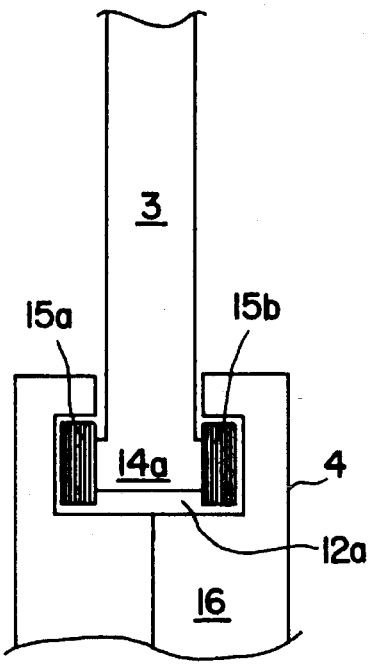
FIGS. 6*a* and 6*b* are partial side views along an edge of the cam driver depicting the cam track with double-ended captured cam followers mounted at the end of a connecting rod for both driving the cam and following it.
Figure 6B:
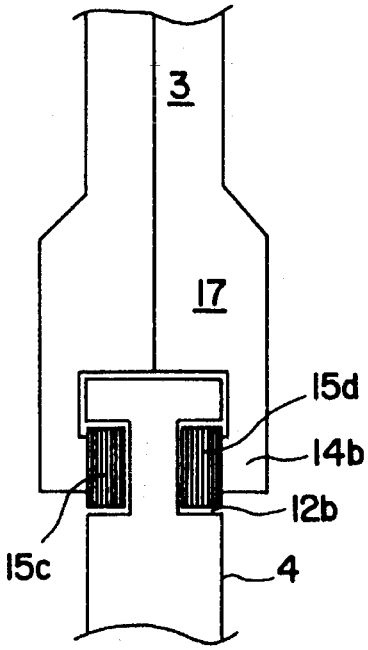

FIGS. 6*a*, 6*b* depict two types of cam followers 14*a*, 14*b* captured in cam tracks 12*a* and 12*b* respectively. Cam follower 14*a* has two roller bearings 15*a*, 15*b* mounted on the outside of the connecting rod shaft 3 and interior to a track 12*a* of a split cam driver track section 16. On the other hand, cam follower 14*b* has two roller bearings 15*c*, 15*d* mounted on the inside of a split end section 17 of the connecting rod shaft 3 and exterior to a track 12*b*, which in this case makes the cam driver of simple construction. In both cases the bearings are snug fitting to the track and able to apply both upwards and downwards forces on the cam track and connecting rods.

Figure 7:
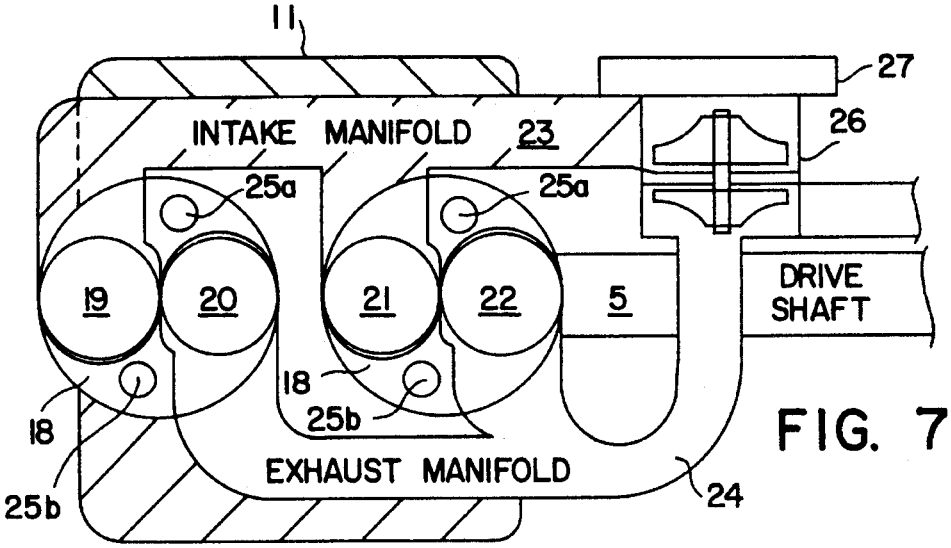
FIG. 7 is an approximately ⅜ scale side view partial schematic drawing of a four cylinder opposed-piston type engine which more optimally makes use of both the three-stroke aspect and the preferred cam type rotating driver device.

FIG. 7 is an approximately ⅜-scale side-view drawing of the preferred opposed-piston type engine 11 of FIG. 4 depicting, in partially schematic form, two cylinders 18 with intake valves 19, 21 and exhaust valves 20, 22 and intake manifold 23 and exhaust manifold 24. The cylinders would scale to relatively large bores of 4" and would preferably have two plugs 25*a* and 25*b* per cylinder located about ⅔ from center to produce a preferred average inward burning front. The ignition would preferable be of the high power type able to deliver hundreds of watts of ignition power to insure good combustion of highly diluted mixtures for further pumping loss reduction and low emissions as disclosed. Noteworthy is the unusually low height profile of the engine (12" shown when scaled) brought about, in part, from the use of the cam drivers 4*ac*, 4*bc* of FIG. 7*a* (approximately ⅜-scale). Also shown in this preferred embodiment is a compact, low profile, quick response turbocharger 26 for supplying the additional required air at high power, and the air-filter 27.

Figure 7A:
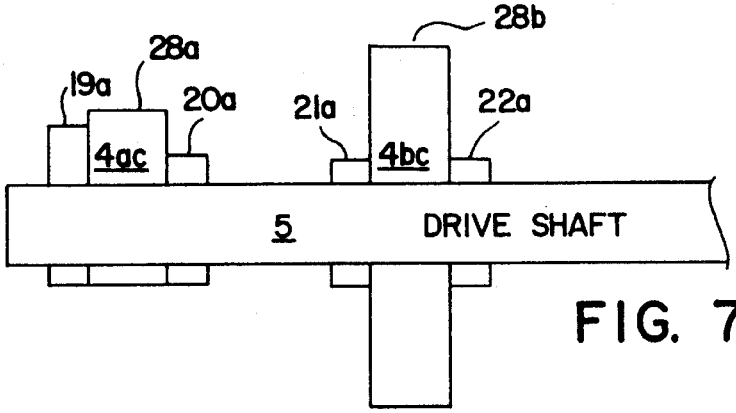
FIG. 7*a* depicts the drive shaft and two cams which the four cylinder opposed-piston engine would preferably employ.
Figure 8A:
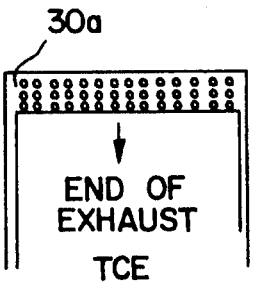
FIGS. 8*a* to 8*d* depict side views of an engine cylinder during the intake through compression process of the disclosed three-stroke engine employing air swirl in the combustion chamber to improve dilute combustion capability with high exhaust residual.
Figure 8B:
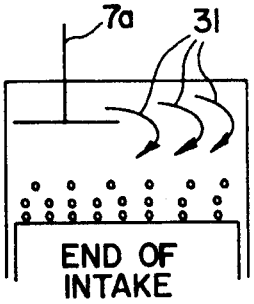
Figure 8C:
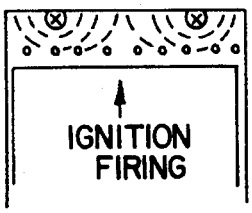
Figure 8D:
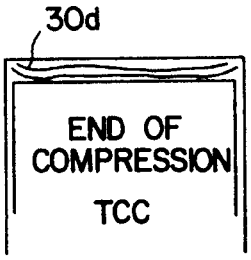

In FIG. 7*a*, are shown mounted on the shaft 5 adjacent to the two cam drivers 4*ac*, 4*ab* four cam lobes 19*a*, 20*a*, 21*a*, 22*a* for actuating the four valves 19, 20, 21, 22 respectively located adjacent, versus in-line, with the cam driver edges 28*a*, 28*b* to take advantage of the half of normal speed (for a four cycle engine) of the "cam" drive shaft 5.

FIGS. 8*a* to 8*d* depict piston motion during the intake and compression strokes of the three-stroke engine disclosed in the preferred embodiment where the cylinder clearance 30*a* (FIG. 8*a*) at top center exhaust (TCE) is approximately twice the clearance at top center compression (TCC) for higher exhaust dilution for lower NOx. In this embodiment is employed air swirl 31 through the intake valve 7*a* which can be masked by the cylinder head as shown, or by other well known techniques. The swirl helps locate the exhaust residual (shown as dots in the figures) at the bottom of the cylinder near the piston top at bottom center intake (BCI) of FIG. 8*b*. The swirl motion becomes disorganized at compression to microscale turbulence, useful for speeding combustion of dilute mixtures. Some stratification is preserved at the ignition time, especially at idle speeds (in part as a result of the small compression stroke) to further insure good idle stability with low HC and NOx.

Figures 9A, 9B, 9C:
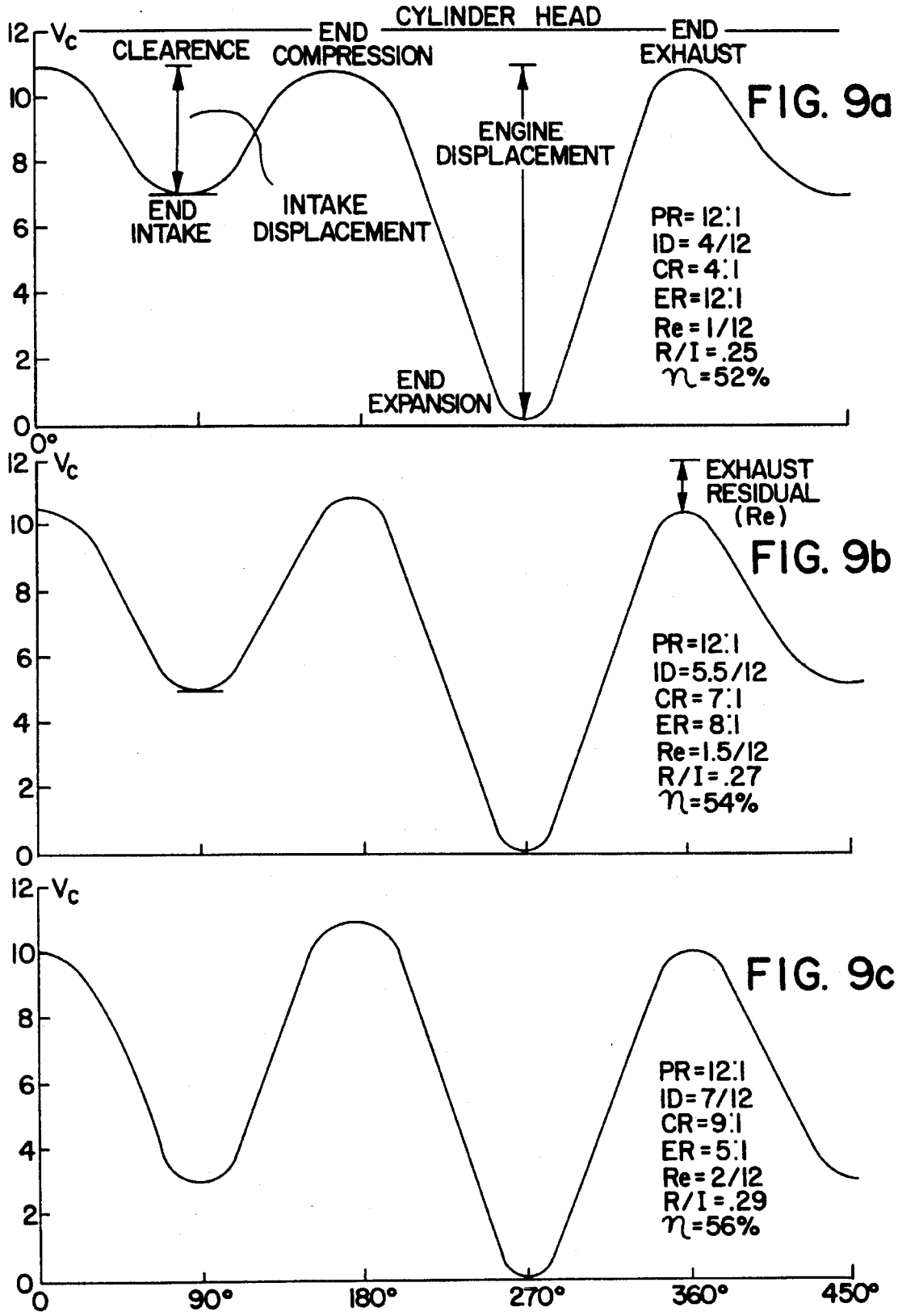
FIGS. 9*a* through 9*c* are curves depicting piston position versus shaft angle to illustrate a preferred embodiment of the invention.

FIGS. 9*a* through 9*c* are curves depicting the top of the piston motion as a function of the drive shaft (and cam driver) angle. Arbitrary units have been assigned for the vertical axis Vc designating cylinder volume, ranging from 0 to 12, where 12 represents the cylinder top (cylinder head). These figures depict an optimized way of operating the three-stroke engine for best efficiency with minimum emissions. FIG. 9*a* represents light load (e.g. idle), FIG. 9*b* moderate load, and FIG. 9*c* high load.

In FIG. 9*a* the intake displacement is ⅓ the total displacement, indicated as ID=4/12 on the figure, or 4 units out of a possible 12, i.e. as a fraction of total displacement. The designation PR represents expansion ratio (12:1 shown), and CR=4:1 and ER=12:1 as shown. "Re" indicates exhaust residual which is proportional to the clearance at the end of the expansion stroke (1/12 in this case expressed as a fraction of total displacement). "R/I" indicates the ratio of exhaust residual to intake air which is a measure of NOx reducing capability (the higher R/I is the greater the NOx reducing capability). R/I progressively increases with load (from 0.25, to 0.27, to 0.29) as indicated in this preferred embodiment to correspond to increase in NOx with load. The cycle efficiency of this light load cycle is 52%. Intake and exhaust clearances are equal to give good idle stability.

In the moderated load case both the exhaust clearance increases (ER=8:1) as well as the intake stroke (ID=5.5/12). The compression ratio correspondingly increases (CR=7:1) to increase the cycle efficiency to 54%.

Finally, in the high load case the exhaust clearance is maximum (ER=5:1) as is the intake stroke (ID=7/12). This results in a maximum compression ratio of 9:1 and maximum cycle efficiency of 56%.

In the above calculations the air-fuel mixture properties were assumed constant which they may not be depending on dilution strategy used. Typically, the best emissions and efficiency trade-off is obtained by operating the engine lean (mostly air dilution) at light loads (consistent with the residual fraction Re indicated), and with entire exhaust dilution at higher loads for stoichiometric air-fuel ratio controlled by lambda sensors. A three-way catalyst is used for emissions reduction (preferably a compact close-coupled catalyst which will be able to tolerate the lower exhaust temperatures of this high expansion ratio engine).

For greater clarification the engine disclosed herein will also be referred to as a "virtual three-stroke engine". Also, "real world drive cycle" refers to the typical vehicle driving conditions in terms of speed and load of a passenger car in a typical urban environment, recognizing that these may somewhat vary from country to country and region to region. However, in all cases the engine spends by far the majority of its time at part load (less than full torque defined by the engine inducting a maximum mount of air as defined by the (maximum) engine displacement).

An important realization is that the throttling pumping loss and frictional loss of the virtual three-stroke engine, designed along the criteria of FIGS. 9*a* through 9*c*, are minimum over the real world drive cycle (so that the intake air throttle may even be eliminated). The throttling power loss Pd is given by the equation:

$$Pd=.4*dP*\ v(\text{flow})$$

where Pd is in horsepower, dP is pressure drop across the throttle in lbs/square inch, and v(flow) is the air-flow in CFM (cubic feet/minute). Sample calculations will show these losses to be high, i.e. of the same magnitude as the brake power at very light loads, i.e. the brake specific fuel consumption (BSFC) can be as high as three times the indicated specific fuel consumption (ISFC) at very light loads.

It can be seen, given the relatively high cycle efficiencies (which are only slightly compromised in the virtual three-stroke engine), and the near elimination of throttling losses and the minimum friction, that what has been defined and disclosed herein is an optimum engine for the real world drive cycle in terms of maximum efficiency. The engine can also be made to operate with very low NOx emissions through the lower peak temperatures resulting from the lower adiabatic heating of the mixture from the lower compression ratio and from use of higher exhaust residual as disclosed. Actual overall efficiency will ultimately depend on how closely one can simulate the preferred cycles shown in an actual engine. Note that even with the use of a small turbo for power, the efficiency is high at high loads since there will be sufficient exhaust flow to easily drive the turbo (which may be designed to supply air at high exhaust dilution levels for very low NOx).

Figure 10A:
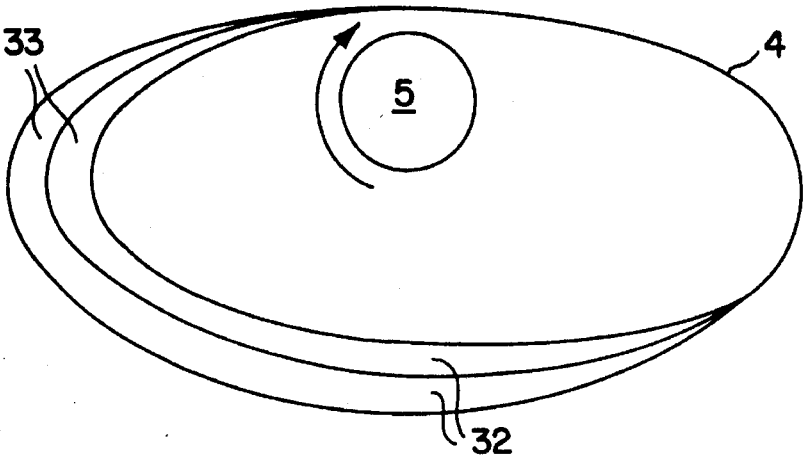
FIGS. 10*a* and 10*b* are partial schematic drawings of a cam driver means with a contoured edge and cam follower means designed to achieve some of the preferred features embodied in the drawings of FIGS. 9*a* through 9*c*.
Figure 10B:
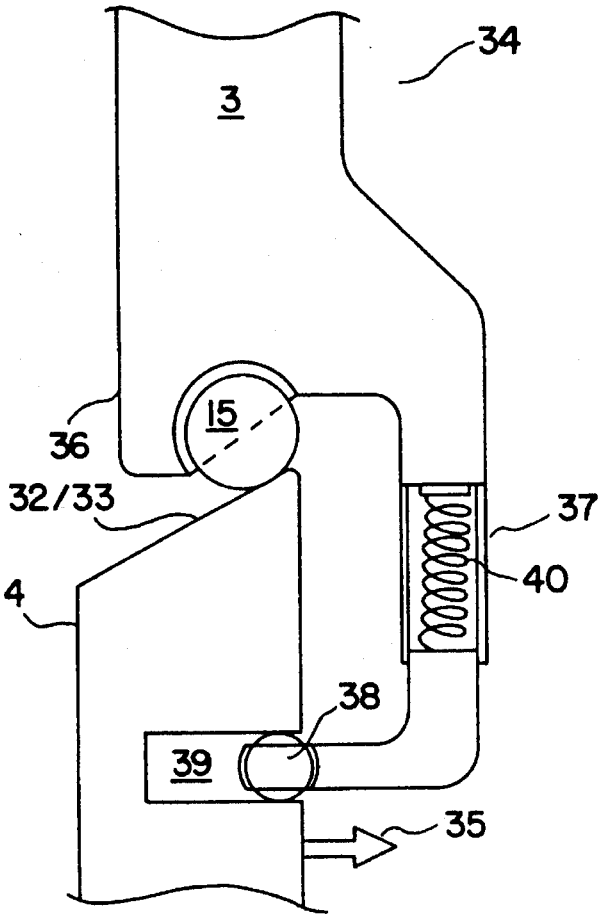

FIGS. 10*a* and 10*b* depict a cam driver and special cam follower which permits most of the features disclosed in FIGS. 9*a*, 9*b*, 9*c* to be realized (the basic motions but with less amplitude). These drawings indicate one possible relatively simple mechanism based on the cam driver 4 and cam follower disclosed, and is by no means the only one. FIG. 10*a* is a schematic end view (showing the face) of the cam driver 4 shown turning clockwise around the shaft 5 and having a contoured edge along two of the four main edge surfaces, the contoured edge 32 defining the variable intake stroke (shown as three lines to indicate the three cases of FIGS. 9*a*, 9*b*, 9*c*), and the contoured edge 33 defining the variable exhaust strokes (and variable, increasing residual with load). The operation for making use of the axial variability in the cam edge is through small axial motions of the drive shaft (produced by use of a spline or other mechanism known to those versed in the art) to bring the axial variable edge diameter surfaces (defined with respect to the center of the drive shaft) in contact with the roller beating.

FIG. 10*b* is a partial side view of the cam 4 and cam follower 34 which is designed to follow the contour 32/33 on the cam edge with axial movement of the cam dryer 4 (indicated by the arrow 35). The main ball bearing mount 35 has a ball-in-socket type beating 15 at its end (or other ball bearing allowing for two dimensional motion) to be able to conform to the contour 32/33 and the contour defined by the rotation of the cam 4. The force required to keep the ball bearing from moving upwards and away from the surface is provided by a spring loaded side arm 37 with a roller bearing 38 located in a track 39 in the side of the cam such that it can move sideways to accommodate the small axial motion of the cam driver 4 but cannot move up and down within the track 39. The spring 40 in the side arm 37 stretches and contracts to accommodate the vertical motion of the roller beating 15 with respect to the trapped beating 38 during axial motion of the cam 4 and holds tension between them. In this way, as the engine throttle is depressed, first the low restriction throttle is opened to the wide open condition (WOT) and then an actuator moves the cam axially to increase the intake stroke. In parallel, if a turbo is provided, air boosting will commence to further make up any shortfall in required power and allow for larger exhaust dilution in relation to the turbo's capabilities and the ignition's capability to ignite the dilute mixture.

Operation of the virtual three-stroke engine can be enhanced by any of a number of state-of-the-art engine techniques such as advanced ignition, advanced mixture preparation techniques, intake air-flow modification, dilution control, valve timing, catalysts (in cylinder and exhaust), engine stability sensors for optimizing mixture strength, and others.

Other types of mechanisms are possible to produce the desired engine strokes disclosed. For example, instead of a cam follower and smooth track for the cam driver, a rack-and-pinion type setup could be possible except that the rack would be double sided and of asymmetric elliptical shape.

Finally, it is particularly emphasized with regard to the present invention, that since certain changes may be made in the above apparatus and method without departing from the scope of the invention herein disclosed, it is intended that all matter contained in the above description, or shown in the accompanying drawings, shall be interpreted in an illustrative and not limiting sense.

What is claimed is:

1. Virtual three-stroke electrically ignited internal combustion engine comprising:

(a) means defining at least one relatively fixed chamber for accommodating volume reduction and increase with a movable volume reducing-increasing member therein and defining a zone between the member and the walls of the chamber for variable volume as the movable member moves;

(b) means for admitting air and fuel to said zone and igniting a compressed air-fuel mixture charge in said zone;

(c) power transmission means outside the chamber constructed and arranged for being cyclically driven by, and for driving, the said movable member;

(d) said cyclically movable member producing a complete engine firing cycle as a result of its motion comprising an air intake portion, an air-fuel mixture compression portion including mixture ignition portion, a mixture combustion and expansion power portion comprised of a complete expansion power stroke defining a maximum displacement of said chamber volume Vd, and a burnt gas exhaust portion, and (e) means for effecting said motions of the member comprising said firing cycle constructed and arranged such that the sum of all stroke displacements of said motions comprising said firing cycle equals between 2½ and 3½ times the displacement of said expansion power stroke maximum displacement Vd for at least one operating condition of the engine.

2. The engine of claim 1 wherein said air-intake portion comprised of an intake volume has a total intake displacement volume Vi approximately one half the engine maximum displacement volume Vd.

3. Virtual three-stroke electrically ignited internal combustion engine comprising:

(a) means defining at least one relatively fixed chamber for accomodating volume reduction and increase with a movable volume reducing-increasing member therein and defining a zone between the member and the walls of the chamber for variable volume as the movable member moves;

(b) means for admitting air and fuel to said zone and igniting a compressed air-fuel mixture charge in said zone;

(c) power transmission means outside the chamber constructed and arranged for being cylically driven by, and for driving, the said movable member;

(d) said cyclically movable member producing a complete engine firing cycle as a result of its motion comprising an air intake portion, an air-fuel mixture compression motion including mixture ignition portion, a mixture combustion and expansion power motion comprised of a complete expansion power stroke defining a maximum displacement of said chamber volume Vd, and a burnt gas exhaust portion wherein said intake air portion comprises an intake stroke of total displacement volume Vi wherein Vi is varied and increases with increased engine power over some range of engine power.

4. The engine of claim 3 wherein the exhaust residual clearance volume V(clre) defined as the minimum volume between said movable member and said chamber walls at the end of the burnt gas exhaust portion stroke also increases as the intake displacement Vi increases with engine power.

5. The engine of claim 3 wherein said total intake volume displacement Vi varies between a minimum Vi(min) approximately ⅓ of engine displacement Vd and a maximum Vi(max) of over ½ of Vd.

6. The engine of claim 2 wherein the engine power expansion ratio or ratio of engine displacement Vd to minimum clearance volume at the end of the compression portion or stroke V(clcomp) is approximately equal to 12 to one.

7. The engine of claim 5 wherein the engine power expansion ratio is approximately equal to 12 for at least on operation of said engine.

8. The engine of claim 7 wherein the engine compression ratio is less than the expansion ratio.

9. The engine as defined in claim 1 wherein multiple such combinations of chamber defining means are provided in an array of synchronized strokes and share a common power transmission customary to multi-cylinder IC engines.

10. The engine of claim 2 wherein at least two of said multiple combinations are arranged in opposing balanced form.

11. The engine of claim 10 as a four cylinder engine with two pairs of directly opposed horizontally arrayed cylinder chambers in a vehicle for driving it, the movable member being reciprocating pistons in said cylinders.

12. The engine of claim 11 including intake air boosting turbocharger means for compressing the intake air during high power engine requirements.

13. The engine of claim 12 wherein said turbocharger is small, quick-response turbocharger capable of supplying mass of air at a minimum equal to the engine displacement Vd at atmospheric pressure.

14. The engine of claim 13 wherein said engine power transmission means comprises two asymmetric generally elliptically shaped cam drivers mounted on a drive shaft orthogonal to the piston motions, each cam driver operating a pair of pistons through connecting rods rigidly mounted to each piston through cam follower contact means between the connecting rod ends and the cam edge surface such that one revolution of the drive shaft equals one complete firing cycle of the engine.

15. The engine of claim 14 wherein said cam follower contact means comprise two roller bearings mounted at the end of the connecting rod and contained in a track or groove near the end of the cam driver edge surface such that the bearings are trapped from moving along the connecting rod direction but are free to move along said track to follow an asymmetric generally elliptical path defined by the cam edge surface.

16. The engine of claim 15 wherein dimensions defined by the edge of said asymmetric elliptical cam with respect to the drive shaft center point has two approximately equal length dimensions defining the end of a long expansion power stroke and an exhaust stroke and one of the two width dimensions essentially of zero length to define the end of the expansion stroke and the other longer width dimension to define the end of the intake stroke.

17. The engine of claim 16 wherein said drive shaft also has mounted adjacent to said corn drivers valve controlling cam lobe means.

18. The engine of claim 16 wherein the ratio of the cylinder bore to the maximum stroke, defined by the maximum possible displacement of the piston, is greater than one.

19. The engine of claim 18 including two ignition means per cylinder and combustible air-fuel mixture charge control means being constructed and arranged to effect the mixture ratio to include highly dilute mixtures of gas fuel ratio at least 1.25 times stoichiometry at some condition of operation of said engine.

20. The engine of claim 17 wherein air-swirl means are incorporated in the engine air intake system for producing air-swirl for at least one condition of the engine operation.

21. An electrically ignited internal combustion, IC, engine including an air-fuel mixture admitting stroke of length Li, a mixture compression and ignition stroke of length Lc, an expansion power stroke of length Lp representing the longest of the strokes and corresponding to the total engine displacement, and an exhaust stroke Le, wherein for at least one operation of said engine said intake stroke Li is approximately ½ of the expansion stroke Lp and the compression stroke is approximately equal to or greater than the intake stroke Li.

22. The engine of claim 21 wherein the exhaust stroke Le is approximately equal to and less than the expansion stroke Lp.

23. The engine of claim 22 wherein the intake stroke Li varies with engine load from a small value of about ⅓ of Lp at light load to a maximum of less than or equal to Lp at high load.

24. The engine of claim 22 wherein the expansion ratio is approximately 12 to one and the compression ratio is between approximately 6 to one and 8 to one.

25. The engine of claim 21 with a compression ratio of approximately 7 to one and an expansion ratio of approximately 11 to one.

26. An electrically ignited internal combustion, IC, engine having at least one piston and one cylinder and including an air-fuel mixture admitting intake stroke of length Li, a mixture compression and ignition stroke of length Lc, an expansion power stroke of length Lp representing the longest of the strokes and corresponding to the total engine displacement, and an exhaust stroke Le, wherein for at least one operation of said engine said intake stroke Li is approximately ½ of the expansion stroke Lp and the compression stroke is approximately equal to or greater than the intake stroke Li, and wherein said differing stroke lengths are produced by cam driver means of asymmetric generally elliptical shape in a track on whose edge or near whose edge ride one end of connecting rods whose other ends are rigidly connected to pistons, said cam driver means mounted on a drive shaft whose axis is perpendicular to the connecting rods.

27. The engine of claim 26 wherein the cam means end of the piston comprises roller bearings for sliding within a track or edge to apply force and turn said cam and to move under the influence of the cam motion.

28. The engine of claim 27 wherein the cam edge surfaces are modulated such that the two main edge surfaces defining the piston compression and expansion strokes are shaft axially independent and the other two main edge surfaces are contoured in the axial direction such that with axial movement of the drive shaft the intake stroke increases and the exhaust stroke stays unchanged or decreases slightly.

29. The engine of claim 28 wherein the roller bearings are ball-in-socket ball bearings in contact with the cam driver edge and a connecting rod spring loaded side arm is connected to a side groove or track of the cam driver by means of a captured cam follower means to keep the ball bearing in contact with the cam driver edge at all parts of the engine firing cycle.

30. The engine of claim 29 wherein the shape of the asymmetric ellipse and the contour on the cam driver edge are such that through most operating engine conditions of up to ⅔ load the throttling loss is less than half of normal for an equivalent engine of all equal strokes.

* * * * *